US010260851B2

(12) United States Patent
Guyon

(10) Patent No.: US 10,260,851 B2
(45) Date of Patent: Apr. 16, 2019

(54) SYSTEM FOR CONTROLLING AT LEAST ONE ELECTRONIC DETONATOR

(71) Applicant: DAVEY BICKFORD, Hery (FR)

(72) Inventor: Franck Guyon, Auxerre (FR)

(73) Assignee: DAVEY BICKFORD, Hery (FR)

( * ) Notice: Subject to any disclaimer, the term of this patent is extended or adjusted under 35 U.S.C. 154(b) by 35 days.

(21) Appl. No.: 15/555,256

(22) PCT Filed: Feb. 29, 2016

(86) PCT No.: PCT/FR2016/050451

§ 371 (c)(1),
(2) Date: Sep. 1, 2017

(87) PCT Pub. No.: WO2016/139410

PCT Pub. Date: Sep. 9, 2016

(65) Prior Publication Data

US 2018/0347959 A1 Dec. 6, 2018

(30) Foreign Application Priority Data

Mar. 4, 2015 (FR) ..... 15 51823

(51) Int. Cl.
*F42D 1/055* (2006.01)

(52) U.S. Cl.
CPC ..... *F42D 1/055* (2013.01)

(58) Field of Classification Search
CPC ..... F42D 1/04; F42D 1/055
USPC ..... 102/206, 217
See application file for complete search history.

(56) References Cited

U.S. PATENT DOCUMENTS 3,953,804 A * 4/1976 Dethlefsen ..... F42D 1/055 327/396
4,044,681 A * 8/1977 de Mere ..... F42D 1/05 102/206
4,633,779 A * 1/1987 Biggs ..... F42C 11/065 102/206

(Continued)

FOREIGN PATENT DOCUMENTS

AU 2012 272 289 A1 2/2014
WO 2011/014891 A2 2/2011
WO 2012/175012 A1 12/2012

OTHER PUBLICATIONS

International Search Report, dated Apr. 25, 2016, from corresponding PCT application No. PCT/FR2016/050451.

*Primary Examiner* — Samir Abdosh
(74) *Attorney, Agent, or Firm* — Young & Thompson

(57) ABSTRACT

A system for controlling at least one electronic detonator generates, as output, an output power supply signal intended to power the at least one electronic detonator and generating commands to fire the at least one electronic detonator, the control system including a control module configured to generate firing commands and to generate a first power supply signal. The control system further includes a power supply module generating a second power supply signal intended to power the at least one electronic detonator, the output power supply signal corresponding to the second power supply signal once a command to fire the at least one electronic detonator has been generated, and corresponding to the first power supply signal as long as no firing command has been generated.

20 Claims, 1 Drawing Sheet

(56) References Cited

U.S. PATENT DOCUMENTS

Figure 1:
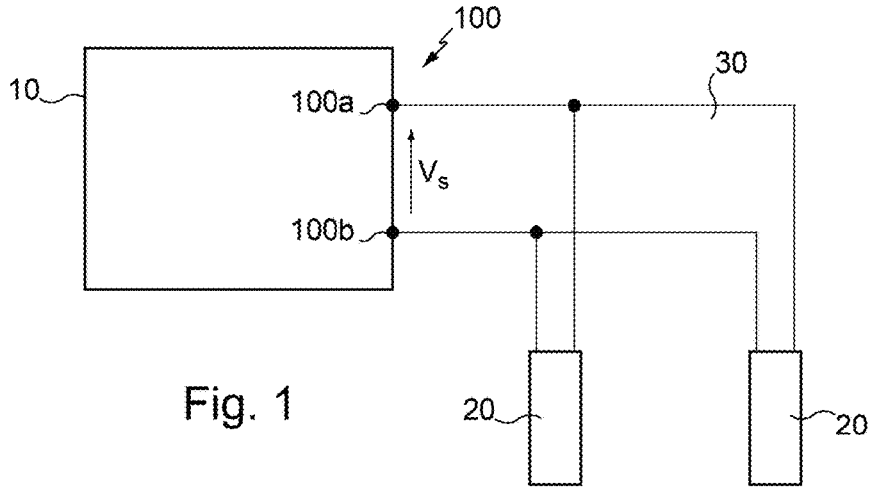

| | | | | |
|---|---|---|---|---|
| 4,646,640 | A * | 3/1987 | Florin | F42D 1/055 102/200 |
| 8,327,764 | B2 * | 12/2012 | Trousselle | F42B 3/182 102/202.3 |
| 8,994,515 | B2 * | 3/2015 | Guyon | F42D 1/055 102/215 |
| 2015/0007740 | A1 * | 1/2015 | Guyon | F42D 1/055 102/215 |

* cited by examiner

SYSTEM FOR CONTROLLING AT LEAST ONE ELECTRONIC DETONATOR

The present invention concerns a control system for controlling at least one electronic detonator In general, a set of electronic detonators is linked to a same control system, the control system being configured to manage the operation of the detonators, as well as to supply the detonators.

Each electronic detonator is linked to the control system by means of electrically conducting wires or firing line, and in particular comprises a detonating charge or explosive, an electronically actuated ignition module or fuse, and memory means for storing a firing delay time, this firing delay time corresponding to the time that elapses between the reception by the electronic detonator of a firing command and the actual firing.

The control system generates a supply signal as output which is adapted to supply the electronic detonators, as well as control signals such as test signals or firing signals respectively adapted to check the proper operation of the detonators and to initiate the firing of the detonators. These supply and control signals generated as output from the control system are sent to the electronic detonators by means of electrically conducting wires.

When the electronic detonators are fired, a high potential difference is generated between the electrically conducting wires and a reference potential, such as that represented by the electrical ground.

In order to avoid damage to the control system by this high potential difference, protection means are implemented such as Galvanic isolation means disposed between the electrically conducting wires and the control system.

Despite the presence of the protection means, a certain number of control systems is damaged by this high potential difference.

One solution to avoid damage to the control system is to electrically separate the electronic detonators from the control system once the firing command is sent to the detonators. In such a case, as the electronic detonators are able to include supply means integrated with them, they are supplied by their own supply means.

Nevertheless, there are risks of non-firing of an electronic detonator in case of fault of its supply means integrated with it.

The present invention is directed to providing a control system for controlling at least one electronic detonator in which the protection against overvoltages in the electrically conducting wires connecting the control system to said at least one electronic detonator is improved.

In this connection, according to a first aspect the present invention is directed to a control system for controlling at least one electronic detonator generating as output an output supply signal adapted for the supply of said at least one electronic detonator and generating firing commands for firing said at least one electronic detonator, the control system comprising a control module configured for generating firing commands and for generating a first supply signal.

According to the invention, the control system further comprises a supply module generating a second supply signal adapted for the supply of said at least one electronic detonator, the output supply signal corresponding to the second supply signal once a firing command for firing said at least one electronic detonator has been generated, and to the first supply signal so long as no firing command has been generated.

Thus, once the firing of the electronic detonator has been initiated, the supply module takes on the task of the supply of the electronic detonator instead of the command module.

The control module in charge of generating operating commands for the electronic detonator, such as the firing command, is thus preserved from the risks of damage by the potential difference generated in the electrically conducting wires connecting the control system to said at least one electronic detonator, while maintaining the supply of said at least one electronic detonator, and thereby avoiding the risk of non-firing of the detonator.

Thus, so long as a firing command has not been generated by the control system, the output supply signal of the control system corresponds to the first supply signal, that is to say to the supply signal coming from the control module.

It is only after a firing command has been generated by the control module, that is to say once the firing command has been generated, that the output supply signal of the control system corresponds to the second supply signal, that is to say to the supply signal coming from the supply module.

According to a feature, the control system comprises output switching means enabling said first supply signal to be replaced by said second supply signal as output from the control system once a firing command for firing said at least one electronic detonator has been generated.

The output control means enable a simple implementation to connect either the control module or the supply module to the output of the control system.

In practice, the output switching means comprise first switching means and second switching means, the first switching means being disposed between the control module and the output of the control system and the second switching means being disposed between the supply module and the output of the control system.

Thus, the first switching means enable the control module to be connected to or disconnected from the output of the control system. When the control module is connected to the output of the control system, the first supply signal is delivered to the output of the control system. On the contrary, when the control module is disconnected from the output of the control system, the first supply signal is not delivered to the output of the control system.

In similar manner, the second switching means enable the supply module to be connected to or disconnected from the output of the control system. Thus, the second supply signal is delivered to the output of the control system when the supply module is connected to the output of the control system. On the contrary, the second supply signal is not delivered to the output of the control system when the supply module is disconnected from the output of the control system.

According to a feature, the first switching means and the second switching means have an open state or a closed state and once a firing command has been generated, the second switching means are put into closed state and the first switching means are put into open state once the second switching means are in closed state.

Thus, so long as a firing command has not been fully generated, the first switching means are in closed state, and the second switching means are in open state. Once a firing command has been generated, the second switching means are put into closed state and then the first switching means are put into open state.

Thanks to the aforementioned changes in state of the switching means, once a firing command has been generated, the supply module is connected to the output of the control system in place of the control module.

Therefore, once a firing command has been generated, the first supply signal is replaced by the second supply signal.

According to a feature, the control system further comprises input switching means disposed upstream of the supply module.

The input switching means enable the supply module to be connected to or disconnected from the electronic circuits situated upstream.

Advantageously, the input switching means have an open state or a closed state, once a firing command has been generated, the second switching means are put into closed state once the input switching means are in open state.

Once a firing command has been generated, the input control means are put into open state, the supply module thus being disconnected from the electronic circuits situated upstream.

Thus, a possible overvoltage present on the firing line would not damage electronic circuits situated upstream of the supply module.

According to a feature, the control system comprises an electrical supply source connected to the supply module via the input switching means.

The first supply signal is thus generated on the basis of the electrical energy delivered by the electrical supply source.

Furthermore, the input switching means enable the connection to or the disconnection from the electrical supply source of the supply module.

Thus, so long as no firing command has been generated, the input control means are in closed state.

When the input switching means are in closed state, they enable the connection of the electrical supply source to the supply module.

Once a firing command has been generated, the input control means are in open state, the supply module thus being disconnected from the supply source.

According to an advantageous feature, the control module comprises modulation means generating the first supply signal, the modulation means being configured for generating the first supply signal in phase with the second supply signal once a firing command has been generated.

Thus, there is continuity in the supply of the detonator at the time of the replacement of the first supply signal by the second supply signal.

According to a feature, the supply module comprises energy storage means, the second supply signal being generated by the energy storage means.

For example, the energy storage means comprise a capacitor, the second supply signal being taken at the terminals of the capacitor.

According to a feature, the characteristics of the capacitor are determined so as to store the energy required to supply said at least one electronic detonator for at least a predetermined period of time.

For example a predetermined period of time substantially corresponds to at least one firing delay time.

Thus, said at least one electronic detonator is supplied for at least the time that elapses between the generation of the firing command for firing said at least one electronic detonator and the actual firing of said at least one electronic detonator.

According to a feature, the supply module comprises means for protection of the energy storage means against the overvoltages present at the output of the control system.

The means for protection of the energy storage means against overvoltages enable the supply module to be protected, in particular the energy storage means, against the overvoltages present on the firing line.

As indicated above, once a firing command has been issued, the control module is disconnected from the output of the control system. Due to the disconnection of the control module from the output of the control system, the control module is protected against overvoltages present on the firing line.

Therefore, the control module, as well as the supply module are protected.

According to a second aspect the present invention concerns a system for firing a set of electronic detonators comprising a control system in accordance with the invention, in which the control system is connected to the set of electronic detonators by means of electrically conducting wires.

The firing system of a set of electronic detonators presents advantages analogous to those described earlier with reference to the control system for controlling at least one detonator according to the invention.

Still other particularities and advantages of the invention will appear in the following description.

Figure 2:
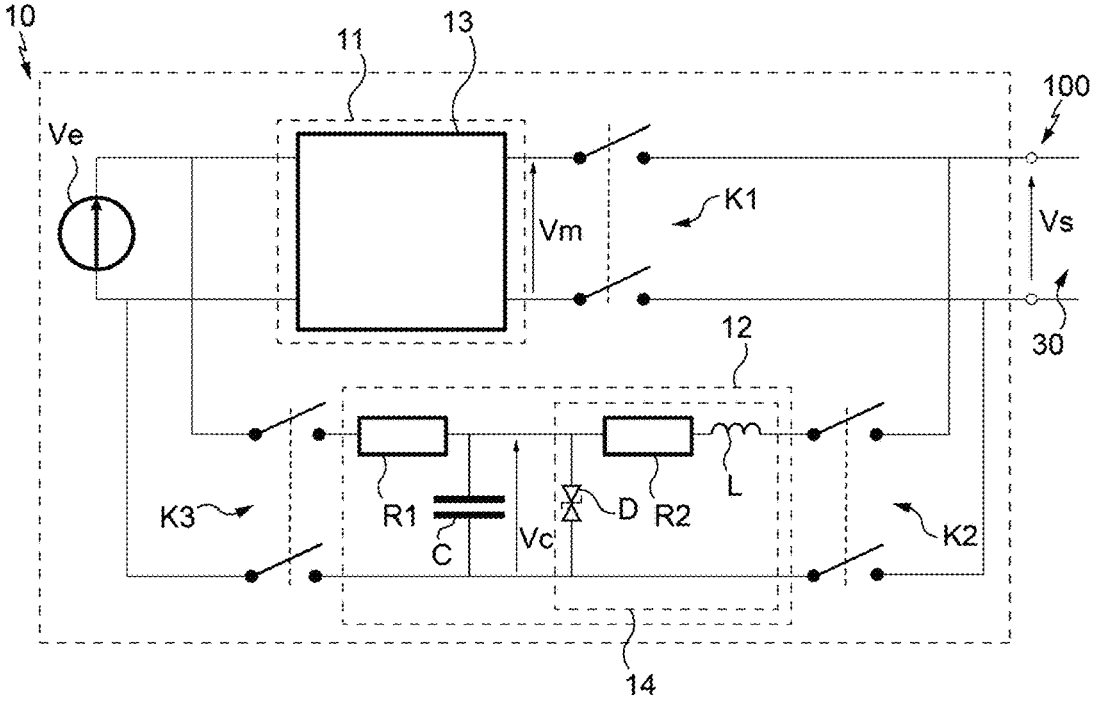

In the accompanying drawings, given by way of non-limiting example:

FIG. 1 diagrammatically represents a system for firing several electronic detonators comprising a control system in accordance with an embodiment of the invention, and FIG. 2 represents a control system according to an embodiment of the invention.

FIG. 1 represents the context of the invention, that is to say a system for firing several electronic detonators, comprising a control system 10 and a set of electronic detonators 20 connected to the control system 10 via electrically conducting wires 30, commonly called firing line.

The control system 10 is given the task in particular of supplying the electronic detonators 20, of checking that they operate correctly and of managing their operation, for example controlling their firing.

For this, the control system 10 comprises electronic circuits necessary for generating supply signals as well as control signals, for example test signals or firing signals. These signals are generated as output 100 from the control system 10 and are sent via electrically conducting wires or firing line 30 to the electronic detonators 20.

According to an embodiment, the control system 10 comprises an output 100 comprising two input/output terminals 100*a*, 100*b*. The electrically conducting wires 30 are connected to the input/output terminals 100*a*, 100*b* and are furthermore connected to the electronic detonators 20.

FIG. 2 represents a control system 10 comprising an output 100, to which the electronic detonators 20 are connected via electrically conducting wires 30.

The control system 10 generates, at the output 100, an output supply signal Vs adapted for the supply of the electronic detonators 20.

The control system 10 comprises a control module 11 comprising electronic circuits required for managing the operation of the set of electronic detonators and for communicating with them. Thus, the control module 11 is configured for generating commands for the electronic detonators 20, such as test commands or firing commands, as well as a first supply signal Vm adapted for the supply of the electronic detonators 20.

In particular, the control module 11 comprises modulation means 13 configured for modulating an input voltage so as to generate commands adapted for the electronic detonators 20.

The input voltage of the modulation means 13 comes from an electrical supply source Ve connected as input to the control module 11.

The control system 10 further comprises a supply module 12 generating a second supply signal Vc adapted for the supply of the electronic detonators 20.

Thus, the first supply signal Vm at the output from the control module 11 is generated from electrical energy delivered by the electrical supply source Ve.

The control system 10 comprises first switching means K1 disposed between the control module 11 and the output 100 of the control system 10 and second switching means K2 disposed between the supply module 12 and the output 100 of the control system 10.

The output switching means K1, K2 make it possible to connect either the output of the control module 11 or the output of the supply module 12 to the output 100 of the switching system 10, and thus to generate at the output 100 either the first supply signal Vm coming from the control module 11, or the second supply signal Vc coming from the supply module 12.

The first switching means K1 and the second switching means K2 may have an open state or a closed state.

When the first switching means K1 are in closed state, the control module 11 is connected to the output 100 of the control system 10. When they are in open state, the control module 11 is not connected to the output 100 of the control system 10.

In similar manner, when the second switching means K2 are in closed state the supply module 12 is connected to the output 100 of the control system 10. When they are in open state, the supply module 12 is not connected to the output 100 of the control system 10.

Thus, when the first switching means K1 are in closed state and the second switching means are in open state, the first supply signal Vm is delivered to the output 100 of the control system 10. When the first switching means K1 are in open state and the second switching means K2 are in closed state, the second supply signal Vc is delivered to the output 100 of the control system 10.

The first output switching means K1 and the second output switching means K2 respectively comprise at least one relay enabling the control module 11 and the supply module 12 to be connected to or disconnected from the output 100 of the control system 10.

For example, the relays are of electromagnetic type. This type of relay has the advantage of ensuring the isolation for the voltages of high value.

Of course, other types of relay could be used for example such as electronic relays.

In an embodiment, the output switching means K1, K2 comprise a relay mounted in each conducting wire connected to the output 100 of the control system 10.

In practice, in operation of the control system 10, the output supply signal Vs corresponds to the first supply signal Vm, coming from the control module 11, except after the issuing of a firing command by the control module 11, in which case, the first supply signal Vm is replaced by the second supply signal Vc coming from the supply module 12.

Thus, once a firing command has been generated by the control module 11, the replacement of the first supply signal Vm by the second supply signal Vc is implemented.

For this, in operation of the control system 10, if no firing command has been generated, the first switching means K1 are in closed state, and the second switching means K2 are in open state such that the first supply signal Vm is delivered to the output 100 of the control system 10.

Once a firing command has been generated by the control module 11, the second switching means K2 are put in closed state, and then the first switching means K1 are put in open state such that the second supply signal Vc is delivered to the output 100 of the control system 10.

In this way, once a firing command has been generated by the control system 10, bound for the electronic detonators 20, the control module 11, comprising the electronic boards necessary to manage the operation of the set of electronic detonators 20 and to communicate with them, is disconnected from the electrically conducting wires 30 connecting the control system 10 to the set of electronic detonators 20. The control module 11 is thus preserved from the risks presented by the overvoltages which may arise on the electrically conducting wires 30.

In order to provide the supply of the electronic detonators 20 during their firing, the supply module 12 is connected to the electrically conducting wires 30 in order to deliver the second supply signal Vc adapted to supply the electronic detonators 20 during their firing.

It will be noted that in the embodiment described, the second switching means K2 are put into closed state and that the first switching means K1 are then put into open state.

Thanks to the change in state of the switching means K1, K2 in the aforementioned order, it is ensured that the electronic detonators 20 are continuously supplied.

Input switching means K3 are disposed between the electrical supply source Ve and the supply module 12, it being possible for the electrical supply source Ve to be connected to the supply module 12 via input switching means K3 depending on their state.

The input switching means K3 may have an open state or a closed state.

When the switching means K3 are in a closed state, the electrical supply source Ve is connected to the supply module 12, and when the input switching means K3 are in open state, the electrical supply source Ve is disconnected from the supply module 12.

According to an embodiment, like the output switching means K1, K2, the input switching means K3 comprise at least one relay.

In the described embodiment, the relay is an electromechanical relay.

In other embodiments, the input switching means K3 may comprise an electronic relay.

In the described embodiment, a relay is mounted in each conducting wire connecting the electrical supply source Ve and the supply module 12.

For generating the second supply signal Vc, the supply module 12 comprises energy storage means.

In an embodiment, the energy storage means comprise a capacitor C.

In this embodiment, the input switching means K3 are connected to the terminals of the capacitor C.

The second supply signal Vc is taken at the terminals of the capacitor C.

The capacitor C is charged with the energy delivered by the supply source Ve when the input switching means K3 are in closed state. The input switching means K3 are in closed state when no firing command has been generated.

Thus, so long as no firing command has been generated, the energy supply source Ve delivers electrical energy to the control module 11, as well as to the supply module 12. While the first supply signal Vm is generated at the output 100 of the control system 10, the capacitor C stores energy delivered by the electrical supply source Ve.

Once a firing command has been generated, the input switching means K3 are commanded into open state, the supply module 12 thus being disconnected from the electrical supply source Ve.

The supply module 12 further comprises a first resistor R1 mounted between the input switching means K3 and the capacitor C This first resistor R1 enables the charging current of the capacitor C to be limited.

The supply module 12 further comprises protection means 14 of the capacitor C against the overvoltages present at the output 100 of the control system 10, for example coming from the electrically conducting wires 30.

In an embodiment, the protection means 14 comprise a second resistor R2, a diode D and an inductor L.

The diode D is mounted in parallel with the capacitor C, the second resistor R2 is mounted between the diode D and the inductor L, the inductor L being connected to the second output switching means K2.

The characteristics of the capacitor C are determined so as to store the energy necessary to supply a set of electronic detonators 20 for a predetermined period of time.

In an embodiment, the predetermined period of time substantially corresponds to a firing delay time.

In a detonation system comprising a set of electronic detonators 20, each electronic detonator 20 is programmed with a delay time.

In an embodiment, the predetermined period of time substantially corresponds to the maximum firing delay time.

Thus, the set of electronic detonators 20 is supplied by the energy delivered by the capacitor C during the firing phase.

The capacitor C must therefore be dimensioned so as to maintain the second supply signal Vc over the predetermined period of time corresponding to the maximum firing delay time.

The dimensioning of the capacitor C also takes into account the number of electronic detonators 20 connected via the electrically conducting wires 30 to the control system 10.

By way of example that is in no way limiting, in a firing system comprising 1500 electronic detonators connected to the control system 10 via the electrically conducting wires 30, in which the maximum delay time is 16 seconds, a capacitor of 0.36 F capacitance could be used.

In the described embodiment, the input switching means K3 and output switching means K1, K2 are commanded into open or closed state such that the electronic detonators 20 are always supplied.

Thus, the second output switching means K2 are commanded to close before the first output switching means K1 are commanded to open.

Furthermore, the second output switching means K2 are commanded to close once the input switching means K3 have been commanded to open.

Moreover, when the supply module 12 takes over from the control module 11 in the supply of the detonators 20, that is to say at the time at which the second output switching means K2 are commanded to close (the first output switching means K1 then being commanded to open), the first supply signal Vm (or the output supply signal Vs) and the second supply signal Vc must be in phase.

The placing in phase of one signal relative to another is not detailed here, since the implementation of such an operation is known by a person skilled in the art.

It will be noted that the replacement of the first supply signal Vm by the second supply signal Vc is implemented after the generation of the firing command but before a first actual detonation of a detonator of the set of detonators 20.

For this, the minimum delay time attributed to an electronic detonator 20 is determined by taking into account the switching time of the output switching means K1, K2 and of the input switching means K3. Thus, the minimum delay time has a sufficiently high value for the output switching means K1, K2 and the input switching means K3 to have changed state.

In summary, according to the embodiment described, once a firing command has been generated by the control system 10, in particular by the control module 11, the first supply signal Vm is generated by the modulation means 13 such that they are in phase with the second supply signals Vc, the input switching means K3 are commanded to open in order to disconnect the electrical supply source Ve from the supply module 12, the second switching means as output K2 are commanded to close so as to connect the supply module 12 to the output 100 of the control system 10, and the first switching means as output K1 are then commanded to open such that the control module 11 (and in particular the modulation means 13) is disconnected from the output 100 of the control system 10.

Thus, when these operations succeed each other in the aforementioned order, the supply the set of electronic detonators 20 is not interrupted on replacement of the first supply signal Vm by the second supply signal Vc.

The invention claimed is:

1. A control system (10) for controlling at least one electronic detonator (20) generating as output (100) an output supply signal (Vs) adapted for the supply of said at least one electronic detonator (20) and generating firing commands for firing said at least one electronic detonator (20), said control system (10) comprising a control module (11) configured for generating firing commands and for generating a first supply signal (Vm), the control system further comprising a supply module (12) generating a second supply signal (Vc) adapted to supply said at least one electronic detonator (20), said output supply signal (Vs) corresponding to said second supply signal (Vc) once a firing command for firing said at least one electronic detonator (20) has been generated, and to said first supply signal (Vm) so long as no firing command has been generated.

2. A control system according to claim 1, further comprising output switching means (K1, K2) enabling said first supply signal (Vm) to be replaced by said second supply signal (Vc) as output from the control system (10), once a firing command for firing said at least one electronic detonator (20) has been generated.

3. A control system according to claim 2, wherein said output switching means (K1, K2) comprise first switching means (K1) and second switching means(K2), said first switching means (K1) being disposed between said control module (11) and the output (100) of said control system (10) and said second switching means (K2) being disposed between said supply module (12) and said output (100) of said control system (10).

4. A control system according to claim 3, wherein the first switching means (K1) and the second switching means (K2) have an open state or a closed state, and wherein once a firing command has been generated, said second switching means (K2) are put into closed state and said first switching means (K1) are put into open state once the second switching means (K2) are in closed state.

5. A control system according to claim 3, further comprising input switching means (K3) disposed upstream of said supply module (12).

6. A control system according to claim 5, wherein the input switching means (K3) have an open state or a closed state, and wherein once a firing command has been generated, said second switching means (K2) are put into closed state once said input switching means (K3) are in open state.

7. A control system according to claim 5, further comprising an electrical supply source (Ve) connected to said supply module (12) via said input switching means (K3).

8. A control system according to claim 1, wherein said control module (11) comprises modulation means (13) generating said first supply signal (Vm), said modulation means (13) being configured to generate said first supply signal (Vm) in phase with the second supply signal (Vc) once a firing command has been generated.

9. A control system according to claim 1, wherein said supply module (12) comprises energy storage means (C), said second supply signal (Vc) being generated by said energy storage means (C).

10. A control system according to claim 9, wherein said energy storage means (C) comprise a capacitor, said second supply signal (Vc) being taken at the terminals of said capacitor (C).

11. A control system according to claim 10, wherein the characteristics of said capacitor (C) are determined so as to store the energy necessary to supply said at least one electronic detonator (20) for a predetermined period of time.

12. A control system according to claim 11, wherein said predetermined period of time substantially corresponds to at least one firing delay time.

13. A control system according to claim 9, wherein said supply module (12) comprises means (14) for protection of said energy storage means (C) against the overvoltages present at the output (100) of said control system (10).

14. A system for firing a set of electronic detonators comprising a control system in accordance with claim 1, the control system (10) being connected to the set of electronic detonators (20) by means of electrically conducting wires (30).

15. A control system according to claim 4, further comprising input switching means (K3) disposed upstream of said supply module (12).

16. A control system according to claim 6, further comprising an electrical supply source (Ve) connected to said supply module (12) via said input switching means (K3).

17. A control system according to claim 2, wherein said control module (11) comprises modulation means (13) generating said first supply signal (Vm), said modulation means (13) being configured to generate said first supply signal (Vm) in phase with the second supply signal (Vc) once a firing command has been generated.

18. A control system according to claim 3, wherein said control module (11) comprises modulation means (13) generating said first supply signal (Vm), said modulation means (13) being configured to generate said first supply signal (Vm) in phase with the second supply signal (Vc) once a firing command has been generated.

19. A control system according to claim 4, wherein said control module (11) comprises modulation means (13) generating said first supply signal (Vm), said modulation means (13) being configured to generate said first supply signal (Vm) in phase with the second supply signal (Vc) once a firing command has been generated.

20. A control system according to claim 5, wherein said control module (11) comprises modulation means (13) generating said first supply signal (Vm), said modulation means (13) being configured to generate said first supply signal (Vm) in phase with the second supply signal (Vc) once a firing command has been generated.

* * * * *